US010597744B2

(12) United States Patent
Rostvall et al.

(10) Patent No.: US 10,597,744 B2
(45) Date of Patent: Mar. 24, 2020

(54) METHOD FOR TREATING TOUGHNESS AND HARDNESS OF DRILL BIT BUTTONS

(71) Applicant: ATLAS COPCO SECOROC AB, Fagersta (SE)

(72) Inventors: Tomas Rostvall, Stockholm (SE); Pär Sundqvist, Fagersta (SE); Thomas Andersson, Stockholm (SE)

(73) Assignee: EPIROC DRILLING TOOLS AKTIEBOLAG, Fagersta (SE)

( * ) Notice: Subject to any disclaimer, the term of this patent is extended or adjusted under 35 U.S.C. 154(b) by 136 days.

(21) Appl. No.: 15/571,117

(22) PCT Filed: May 18, 2016

(86) PCT No.: PCT/SE2016/050451

§ 371 (c)(1),
(2) Date: Nov. 1, 2017

(87) PCT Pub. No.: WO2016/186558

PCT Pub. Date: Nov. 24, 2016

(65) Prior Publication Data

US 2018/0171428 A1 Jun. 21, 2018

(30) Foreign Application Priority Data

May 18, 2015 (SE) ..... 1550631

(51) Int. Cl.
*C21D 9/22* (2006.01)
*B24B 31/108* (2006.01)
(Continued)

(52) U.S. Cl.
CPC ..... *C21D 9/22* (2013.01); *B08B 3/044* (2013.01); *B08B 7/02* (2013.01); *B24B 31/02* (2013.01);
(Continued)

(58) Field of Classification Search
CPC ..... B08B 3/044; B08B 7/02; B24B 31/02; B24B 31/023; B24B 31/03; B24B 31/104;
(Continued)

(56) References Cited

U.S. PATENT DOCUMENTS 1,946,440 A * 2/1934 Herrmann ..... B24B 31/02 144/208.9
3,705,848 A * 12/1972 Vishnitsky et al. .... B24B 31/02 204/213
(Continued)

FOREIGN PATENT DOCUMENTS

EP 2239096 A1 10/2010
GB 1166864 A 10/1969
GB 1348236 A 3/1974

OTHER PUBLICATIONS

International Preliminary Report on Patentability in corresponding international application No. PCT/SE2016/050451 dated Nov. 21, 2017 (9 pages).
(Continued)

*Primary Examiner* — Timothy V Eley
(74) *Attorney, Agent, or Firm* — Venable LLP; Jeffri A. Kaminski

(57) ABSTRACT

A method, performed by a centrifuge, for treating toughness and hardness of drill bit buttons is provided. The centrifuge comprises a chamber formed by a stationary side wall and a bottom which is rotatable around a rotation axis, the bottom comprising one or more protrusions which at least partly extends between the rotation axis and the side wall, the side wall comprising at least six pushing elements arranged around a periphery of the side wall. The method comprises rotating, by rotation of the bottom with the protrusions, the drill bit buttons around the rotation axis, pushing, by the pushing elements, the drill bit buttons from the side wall during the rotation of the bottom, collectively forming the
(Continued)

drill bit buttons into a torus shape at the bottom of the chamber for inducing collisions between the drill bit buttons, thereby treating the toughness and hardness of the drill bit.

11 Claims, 4 Drawing Sheets

(51) Int. Cl.

| | |
|---|---|
| ***B24C 1/08*** | (2006.01) |
| ***B24B 31/02*** | (2006.01) |
| ***B08B 3/04*** | (2006.01) |
| ***B08B 7/02*** | (2006.01) |
| ***B24B 31/03*** | (2006.01) |
| ***B24B 31/023*** | (2006.01) |
| ***C22C 1/10*** | (2006.01) |
| ***C22C 29/08*** | (2006.01) |
| ***C22C 29/14*** | (2006.01) |
| *C22F 1/10* | (2006.01) |
| *C22C 26/00* | (2006.01) |
| *C21D 7/04* | (2006.01) |

(52) U.S. Cl.
CPC ..... *B24B 31/023* (2013.01); *B24B 31/03* (2013.01); *B24B 31/108* (2013.01); *B24C 1/08* (2013.01); *C22C 1/1094* (2013.01); *C22C 29/08* (2013.01); *C22C 29/14* (2013.01); *B22F 2998/10* (2013.01); *C21D 7/04* (2013.01); *C22C 26/00* (2013.01); *C22F 1/10* (2013.01)

(58) Field of Classification Search
CPC ..... B24B 31/108; B24B 31/16; B24B 57/00; B24C 1/08; C21D 7/06; C21D 9/22
See application file for complete search history.

(56) References Cited

U.S. PATENT DOCUMENTS

| | | | | |
|---|---|---|---|---|
| 3,948,003 | A * | 4/1976 | Pletscher | B24B 31/00 451/328 |
| 4,958,776 | A * | 9/1990 | Walther | B24B 31/108 241/171 |
| 5,119,597 | A * | 6/1992 | Davidson | B24B 31/108 451/326 |
| 6,733,374 | B2 | 5/2004 | Gegenheimer et al. | |
| 6,821,191 | B2 * | 11/2004 | Lim | A63B 47/04 241/171 |
| 7,549,912 | B2 | 6/2009 | Liang et al. | |
| 2011/0000717 | A1 | 1/2011 | Carlsson et al. | |

OTHER PUBLICATIONS

International Search Report of PCT/SE2016/050451, dated Aug. 5, 2016.
Written Opinion of PCT/SE2016/050451, dated Aug. 5, 2016.
International-Type Search Report of SE 1550631-4, dated Dec. 17, 2015.

* cited by examiner

METHOD FOR TREATING TOUGHNESS AND HARDNESS OF DRILL BIT BUTTONS

CROSS-REFERENCES TO RELATED APPLICATIONS

This application is a U.S. National Stage application of PCT/SE2016/050451, filed 18 May 2016 and published on 24 Nov. 2016 as WO 2016/186558, which claims the benefit of Swedish Patent Application No. 1550631-4, filed 18 May 2015, all of which are hereby incorporated by reference in their entireties.

TECHNICAL FIELD

Embodiments herein relate to a method for treating toughness and hardness of drill bit buttons.

BACKGROUND

Drill bit buttons may be used in different applications such as during rock drilling, earth boring, mining and the like. The drill bit buttons may be attached to e.g. a rock drilling tool which is brought to rotate relatively the surface to be drilled. Such a rock drilling tool and drill bit buttons are disclosed in US20110000717A1. The drill bit buttons may be made of a composite material comprising a hard phase and a binder phase. The hard phase can be e.g. tungsten carbide and the binder phase can be e.g. cobalt.

Drill bit buttons can also be used in other applications, such as during cutting and/or milling of rocks, asphalt, concrete, and other materials.

During manufacture of the drill bit buttons they may be compressed into a selected shape. In order to strain harden the drill bit buttons, polish the surface and to round of any edges they may be treated in e.g. a tumbling, vibratory-, cascading- and/or centrifuge process. Such a process may be referred to as a finishing process or after-treatment of the drill bit buttons.

In U.S. Pat. No. 7,549,912B2 a method for manufacturing drill bit inserts is disclosed. The drill bit inserts are finished in a centrifugal disc finishing machine in which the inserts are subject to a toroidal motion for a time amount of 15-90 minutes.

The method disclosed in U.S. Pat. No. 7,549,912B2 may be suitable in some applications but there remains a need for an efficient method for treating both toughness and hardness of drill bit buttons.

SUMMARY

Embodiments herein aim to provide a method for efficiently treating both toughness and hardness of drill bit buttons.

According to an embodiment, this is provided by a method, performed by a centrifuge, for treating toughness and hardness of drill bit buttons, wherein the centrifuge comprises a chamber formed by a stationary side wall and a bottom which is rotatable around a rotation axis, the bottom comprising one or more protrusions which at least partly extends between the rotation axis and the side wall, the side wall comprising at least six pushing elements arranged around a periphery of the side wall, and where the method comprises;

rotating, by rotation of the bottom, the drill bit buttons around the rotation axis, pushing, by the pushing elements, the drill bit buttons from the side wall during the rotation of the bottom.

Since the method comprises simultaneous rotating and pushing of the drill bit buttons, both the toughness and hardness of the drill bit buttons are increased by the method. The method may be performed for any desired amount of time, but tests have proven that a duration of at least 60 minutes works well in some applications.

In some applications a duration of at least 90 minutes, such as a duration of 90-200 minutes, has proven to work well. In some applications the method is performed until the toughness of the drill bit buttons has increased at least 2 K1c units ($MNm^{-1.5}$) and the hardness has increased at least 10 HV30 units near the surface. The increase of toughness and hardness is most prominent at the surface of the drill bit buttons. In some embodiments the increase of toughness and hardness is most prominent at 0-1 millimetres (mm) from the surface of the drill bit buttons. The method may therefore also be referred to as a method for treating surface toughness and surface hardness of drill bit buttons.

In one example, when the method was performed with cemented carbide drill bit buttons the toughness increased from 16 K1c units to 24 K1c units at 1 mm from the surface and the hardness increased from 1190 HV30 units to 1220 HV30 units at 1 mm from the surface when the method was performed for a duration of 177 minutes. The measurements were made by diamond impressions according to test methods described below.

The combination of the rotating and pushing of the drill bit buttons according to the above-mentioned method has proven to increase both the toughness and the hardness in a very fast and efficient manner. At the same time sharp corners are de-burred and the surface is smoothened. In some applications the method is used for indirect inspection of defects. In such applications the method highlights potential cracks in the drill bit buttons by creating abnormal chipping on any defect drill bit buttons. Hereby such defect drill bit buttons can easily be sorted out.

According to some embodiments the method comprises; collectively forming the drill bit buttons in a circular movement to a steady-state torus shape at the bottom of the chamber for inducing collisions between the drill bit buttons. The drill bits rotate together above but near the periphery of the bottom. The formed torus shape can be achieved by a combination of the above-mentioned design of the chamber and a selected peripheral speed of the chamber. According to some embodiments the method comprises; rotating a periphery of the protrusions at the bottom with a peripheral speed of 4-8 m/s, preferably 4.5-7 m/s. With these peripheral speeds the drill bit buttons collectively form a torus shape or "donut shape" in a lower peripheral part of the chamber. The drill bit buttons continuously circulate together near but above the bottom of the chamber and also make minor movements relatively to each other within the formed torus shape, foremost due to the combined rotating and pushing of the drill bit buttons. The rotating protrusions at the bottom keep the torus rotating with a selected rotation speed which is dependent on the peripheral speed of the bottom. The protrusion will have a slightly higher rotation speed compared to the formed collective torus due to the action of the pushing elements. During the rotation the pushing elements will push drill bit buttons which come into contact with the pushing elements towards a centre of the collectively formed torus. This means that a peripheral surface of the relatively well gathered torus body will be disturbed, slowed down and the pushed drill bit buttons will be directed towards a more central part of the formed torus body. This will cause the drill bit buttons within the torus to almost continuously collide and change place with each other in a relatively pre-determined manner. However, as compared with prior-art centrifuges, for example as described in U.S. Pat. No. 7,549,912B2, the relative positions of the drill bit buttons in embodiments herein will change relatively little. The drill bit buttons will thus constantly move relatively each other during the rotation but the movement is relatively limited and the buttons will stay close to the bottom and periphery of the chamber. The drill bit buttons will avoid climbing high on the chamber walls and fall down onto the bottom. During the internal movements within the rotating torus the drill bit buttons will be subject to a large number of small limited impacts. An impact is thus a collision between a drill bit button and one or more other drill bit buttons within the rotating torus, induced from the disturbance of the rotational movement from the protrusions at periphery of the chamber. If drill bit dummies are used in the method impacts also occurs between the drill bit buttons and the drill bit dummies.

Since the rotating torus has a relatively constant shape or "macro-contour", the impacts will be less severe than if the drill bit buttons had been allowed to leave the torus and move freely with a hurricane like vortex toroidal motion within a major part of the chamber, as described in U.S. Pat. No. 7,549,912B2. In the present method no such free motion is induced. The bit buttons do not climb up the wall, fall down from a relatively large height or change directions. Hereby large impacts are efficiently avoided. This is advantageous since larger impacts, e.g. caused if the drill bit buttons are allowed to travel independently in a cascading or with "individual toroidal movements" within the chamber, may cause unwanted chippings of the drill bit buttons. These chippings tend to occur from the large impacts even for drill bit buttons without defects.

In some embodiments the torus is completely gathered within a lower portion of the chamber and does not reach above a height corresponding to the radius of the chamber. In other words, if the chamber has a diameter of 400 millimetres, an upper portion of the torus of drill bit buttons does not reach above 200 millimetres from the bottom of the chamber. Since the torus is well-gathered in the lower part of the chamber the drill bit buttons will affect each other with a large number of small impacts which increases the toughness and hardness of the drill bit buttons. A further advantage with the torus in the lower part of the chamber is that the chamber may be arranged without any lid. Hereby the movement of the drill bit buttons may be efficiently and easily observed.

According to some embodiments the method comprises; increasing the peripheral speed over a time period of at least five minutes. The peripheral speed can be increased continuously or in one or more steps. In some embodiments the peripheral speed can be increased according to a pre-determined program with several steps. Increasing the peripheral speed over a time period may prevent chipping of the drill bit buttons. Such a program may be adjusted after the shape and weight of the drill bit buttons.

According to some embodiments the method comprises; polishing, preferably by addition of liquid into the chamber, the drill bit buttons. Hereby a surface of the drill bit buttons may become smoother. In some embodiments the method is performed until a roughness of the drill bit button surfaces are less than 1.5 micrometres. In some embodiments the method is performed until a roughness of the drill bit button surfaces are less than 0.8 micrometres. The arithmetic average of absolute values, Ra, may be used for measuring/defining the roughness Ra.

According to some embodiments the method comprises; controlling a temperature of the bits by circulating liquid in the chamber and according to some embodiments the method comprises; filtering, by a filter, the liquid. With filtering of the liquid an amount of loose grits can be controlled.

According to some embodiments the method comprises; cleaning, by addition of detergent into the chamber, the drill bit buttons and according to some embodiments the method comprises; inhibiting corrosion of the drill bit buttons by addition of a corrosion inhibitor into the chamber. Hereby the drill bit buttons are relatively clean and protected from corrosion.

According to some embodiments the method comprises; treating the drill bit buttons together with drill bit button dummies in the chamber. The drill bit button dummies may facilitate to fill up the chamber up to a desired height and/or volume or may be used to make the torus bigger. In some application this may prevent individual toroidal movements and uncontrolled large impacts of the drill bit buttons. The drill bit button dummies may have smaller, equal or larger size than the drill bit buttons. In some embodiments dummies which are larger than the drill bit buttons has proven to work well for preventing chipping of the drill bit buttons.

According to some embodiments the method comprises; providing at least one of the bottom, the protrusions, the side wall and the pushing elements with a plastic and/or rubber surface. This may prevent chipping of the drill bit buttons.

BRIEF DESCRIPTION OF THE DRAWINGS

The various aspects of embodiments herein, including its particular features and advantages, will be readily understood from the following detailed description and the accompanying drawings, in which.

DETAILED DESCRIPTION

Embodiments herein will now be described more fully with reference to the accompanying drawings. Like numbers refer to like elements throughout. Well-known functions or constructions will not necessarily be described in detail for brevity and/or clarity.

Figure 1:
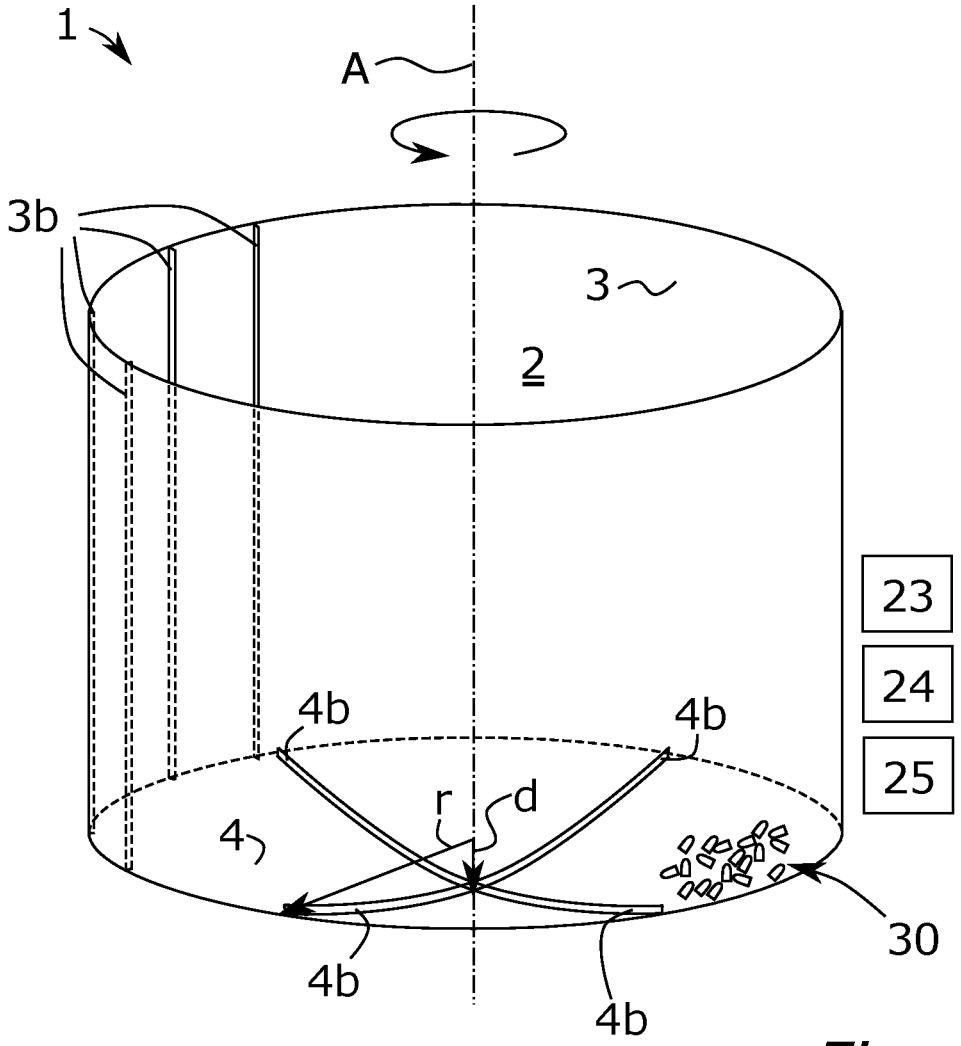
FIG. 1 illustrates a perspective view of a centrifuge according to some embodiments.

FIG. 1 illustrates a centrifuge 1, also referred to as a centrifugal disc machine. The purpose with the centrifuge 1 is to treat toughness and hardness of drill bit buttons 30 which are arranged within a chamber 2 of the centrifuge 1. The chamber 2 is formed by a stationary side wall 3 and a bottom 4 which is rotatable around a rotation axis A. In some embodiments the rotation axis A is substantially vertical and in some embodiments the rotation axis A may be tilted relatively a vertical axis. As illustrated in FIG. 1, the chamber 2 may be arranged as a drum or cylinder.

The bottom 4 comprises one or more protrusions 4*b* which at least partly extends between the rotation axis A and the side wall 3. The protrusions 4*b* may be integrally formed with the bottom or may be attached to the bottom. The one or more protrusions 4*b* may extend from the rotation axis A to the side wall 3. In some embodiments the one or more protrusions 4*b* extend from the rotation axis A and ends before the side wall 3, such that they extend e.g. 70-95% of a radius r between the rotation axis A and the side wall 3. In some embodiments the one or more protrusions 4*b* extends from the side wall 3 and ends before the rotation axis A, such that they extend e.g. 70-95% of the radius r between the rotation axis A and the side wall 3.

In some embodiments the bottom comprises a stationary part, formed by a bottom portion, and a rotatable part, formed by the one or more protrusions. In such embodiments "rotating of the bottom" is to be interpreted as "rotating at least a part of the bottom". Thus, the button surface and/or the protrusions may be rotatable around the rotation axis. The bottom and/or the protrusions may be driven by any kind of suitable motor or rotational means.

The method 10 may then be described as follows:

A method 10, performed by a centrifuge 1, for treating toughness and hardness of drill bit buttons 30, wherein the centrifuge 1 having a rotation axis A and comprises a chamber 2 formed by a stationary side wall 3 and a bottom 4,

- the bottom 4 comprising one or more protrusions 4*b* which at least partly extends between the rotation axis A and the side wall 3,
- the side wall 3 comprising at least six pushing elements 3*b* arranged around a periphery of the side wall 3, and where the method 10 comprises;

- rotating 11, by rotation of the bottom 4 and/or the protrusions 4*b* around the rotation axis, the drill bit buttons 30 around the rotation axis A,
- pushing 12, by the pushing elements 3*b*, the drill bit buttons 30 from the side wall 3 during the rotation of the bottom 4,
- collectively forming 13 the drill bit buttons 30 into a well gathered torus shape 8*b* at the bottom 4 of the chamber 2 for inducing collisions between the drill bit buttons 30, thereby treating the toughness and hardness of the drill bit buttons 30.

The one or more protrusions 4*b* may extend radially outwards from the rotation axis A in a sunshine pattern. In some embodiments the bottom 4 is provided with 2-12 protrusions 4*b*, such as 4-8 protrusions 4*b*. In other embodiments the bottom has fewer or more protrusions 4*b*. The one or more protrusions 4*b* may extend e.g. one or a few centimetres up from the bottom 4, such as between 5-40 millimetres, preferably 10-30 millimetres, from the bottom of the chamber. An upper part of the one or more protrusions may have a rounded shape.

The bottom 4 of the chamber 2 may be substantially flat or may be concave such that a central portion around the rotation axis A is arranged below peripheral parts of the bottom 4. As illustrated in FIG. 1, the central portion may be arranged a depth d below peripheral parts of the bottom 4. In some embodiments the depth d is maximum 50% of the radius r. In some embodiments the depth d is maximum 40% of the radius r. In some embodiments the depth d is maximum 30% of the radius r. In some embodiments the bottom is substantially flat with d being 0 but with a small chamfer and/or radius of 1-2 cm at the outer periphery of the bottom 4. Such chamfer and/or radius are directed upwards to meet the side wall 3.

The side wall 3 comprises at least six pushing elements 3*b* arranged around a periphery of the side wall 3, i.e. on an inner surface of the side wall 3. In some embodiments the side wall 3 comprises a larger number of pushing elements 3*b*, such as at least 20, at least 30 or at least 40 pushing elements. The pushing elements 3*b* are further discussed in conjunction with FIG. 7.

The pushing elements 3*b* may have any shape which allows them to push or direct drill bit buttons 30 away from the side wall 3 when the drill bit buttons 30 are forced towards the side wall 3 due to rotation of the bottom 4. The pushing elements 3*b* can be arranged as protrusions, flanges, or any shape which render the side wall 3 to be non-circular. In some embodiments the pushing elements 3*b* are arranged as a number of grooves, notches and/or cut-outs. In some other embodiments the side wall 3 is arranged as a polygon with a number of sides. The difference in radius around the polygon will then push drill buttons 30 from the side wall 3.

The shape of the bottom 4, the number and design of the one or more protrusions 4*b* and the number and design of the pushing elements 3*b* affects the motion pattern of the drill bit buttons 30 when the bottom 4 is brought to rotate.

The side wall 3 of the centrifuge 1 is stationary and the bottom 4 can be brought to rotate by a motor 24 coupled to the bottom 4 via a coupling arrangement. The centrifuge 1 may also comprise a control arrangement 25, through which the motor 24 and/or the rotation of the bottom 4 can be controlled.

The motor 24 may e.g. be arranged to rotate a periphery of the bottom 4 with a peripheral speed of 4-8 m/s. In some embodiments the motor 24 is arranged to rotate the periphery of the bottom 4 with a peripheral speed of 4.5-7 m/s. The peripheral speed is the speed of the bottom at its periphery.

In some embodiments one or more filters 23 are arranged to filter liquid which is arranged within or circulated through the chamber 2.

Figure 2:
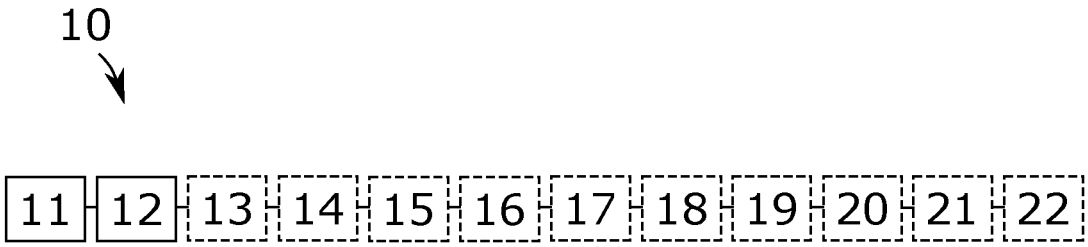
FIG. 2 illustrates a method for treating toughness and hardness of drill bit buttons.

FIG. 2 illustrates a method 10 which comprises: rotating 11, by rotation of the bottom, the drill bit buttons around the rotation axis. The method 10 also comprises the step of pushing 12, by the pushing elements, the drill bit buttons from the side wall during the rotation of the bottom. When the drill bit buttons are treated by the method 10 both the toughness and hardness of the drill bit buttons are increased.

In FIG. 2 also a number of optional method steps are schematically illustrated. The different steps may be combined as desired, e.g. depending on the kind of drill bit buttons treated. The optional steps, indicated by dashed lines in FIG. 2, may thus be selected independently from each other. The steps can be performed simultaneously or in any selected sequence.

Figure 3:
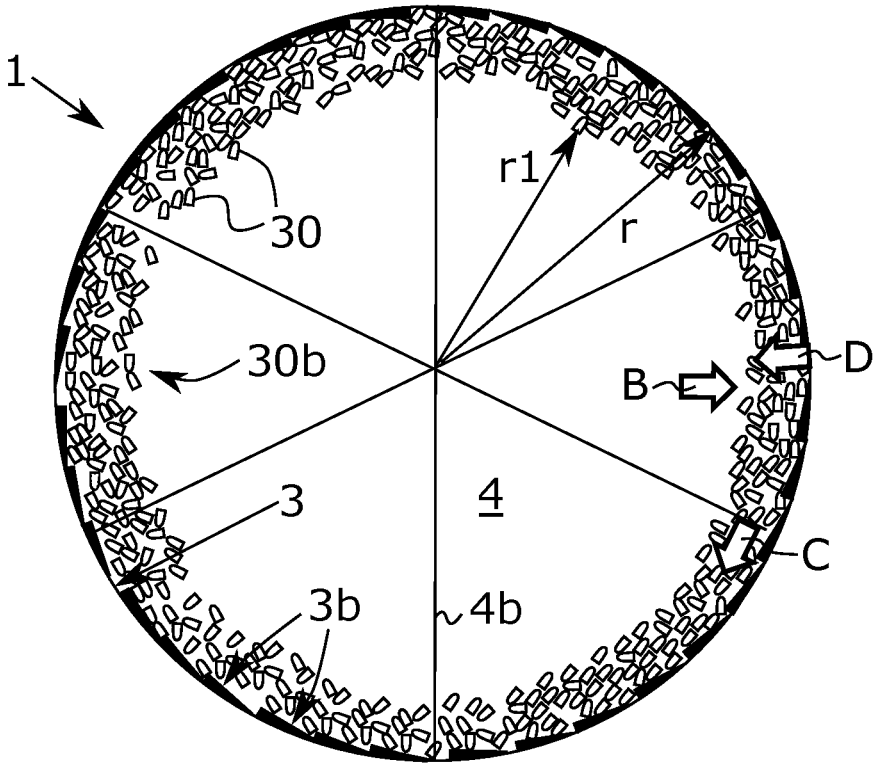
FIG. 3 is a top view of the centrifuge in FIG. 1.
Figure 4:
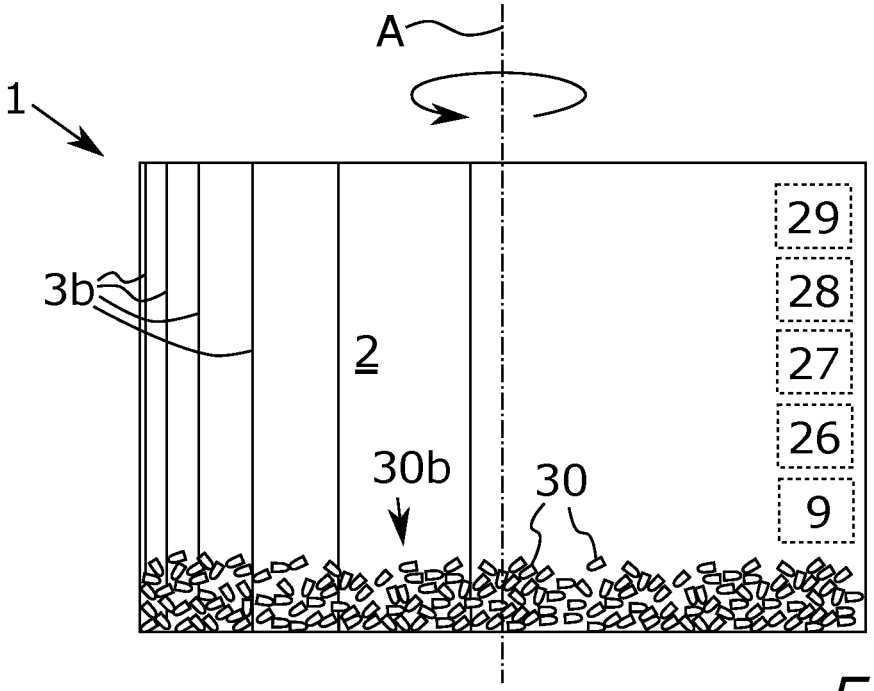
FIG. 4 is a schematic cross sectional side view of the centrifuge in FIG. 1.

In some embodiments the method 10 comprises: collectively forming 13 the drill bit buttons into a torus shape at the bottom of the chamber. The torus shape is illustrated in FIG. 3 and FIG. 4.

In some embodiments the method 10 comprises: rotating 14 a periphery of the bottom and/or the protrusions with a peripheral speed of 4-8 m/s, preferably 4.5-7 m/s.

In some embodiments the method 10 comprises: increasing 15 the peripheral speed of the bottom and/or the protrusions over a time period of at least five minutes. In some embodiments the increasing 15 of peripheral speed comprises a first phase and a second phase which are performed continuously after one another. The first phase may comprise one or more steps for which the peripheral speed of the bottom and/or the protrusions is below 4 m/s and the second phase may comprise one or more steps where the peripheral speed of the bottom and/or protrusions exceeds 4 m/s. Hereby the speed is continuously ramped up and chipping of the drill bit buttons is efficiently avoided.

The peripheral speed may also be expressed as RPM, revolutions per minute. A RPM-number can be converted to a peripheral speed measured in m/s since the radius/diameter of the chamber is known.

In the below example the diameter of the chamber is 359 millimetres, the drill bit buttons are 7-13 mm in diameter and the peripheral speed is increased in the following steps:

| Step | RPM | Time (minutes) |
|---|---|---|
| 1 | 200 | 5 |
| 2 | 240 | 8 |
| 3 | 280 | 30 |
| 4 | 300 | 112 |

The above example of speed increase or ramping-up-periods only serves as an example, in other applications the speed may be increased over different time periods.

In some embodiments the method 10 comprises polishing 16, by addition of liquid into the chamber, the drill bit buttons. The method 10 may also comprise the step of controlling 17 a temperature of the bits by circulating liquid in the chamber and/or the step of filtering 18, by the filter, the liquid.

In some embodiments the method 10 comprises: cleaning 19, by addition of detergent into the chamber, the drill bit buttons. In some embodiments the method 10 comprises inhibiting 20 corrosion of the drill bit buttons by addition of a corrosion inhibitor into the chamber.

The method 10 may also comprise a step of treating 21 the drill bit buttons together with drill bit button dummies in the chamber. In some embodiments the method 10 comprises the step of providing 22 at least one of the bottom, the protrusions, the side wall and the pushing elements with a plastic and/or rubber surface.

In FIG. 3 the centrifuge 1 is illustrated from above when the bottom 4 rotates. Due to centrifugal forces the drill bit buttons 30 are forced towards the side wall 3 and the pushing elements 3*b* such that a torus shape is collectively formed by the drill bit buttons 30. This is indicated by arrow B in FIG. 3.

When the bottom 4 with the one or more protrusions 4*b* rotates around the rotation axis the drill bit buttons 30 are caused to rotate together with the bottom 4. Each protrusion pushes the drill bit buttons 30 in the direction indicated by arrow C when the bottom 4 rotates in a clockwise direction. The protrusions 4*b* may be brought to rotate with different speeds, such as 100 rpm, 160 rpm or 300 rpm. In some applications both toughness and hardness have increased in an efficient manner when the protrusions 4*b* have been brought to rotate with a minimum speed of 160 rpm for at least 90 minutes.

When a drill bit button 30, due to the pushing outwards in the B-direction, has reached the side wall 3 it is pushed back again, i.e. away from the side wall 3 in the direction indicated by arrow D, by means of the pushing elements 3*b*. If no pushing elements had been arranged along the periphery of the side wall 3, the drill bit buttons 30 had been gathered closer to the side wall 3. Further, if no pushing elements had been arranged along the periphery of the side wall 3, the drill bit buttons 30 had been climbing upwards along the walls of the chamber in a manner resembling of the hurricane-like-movement described in U.S. Pat. No. 7,549,912B2.

When the drill bit buttons 30 are continuously pushed/forced in the B, C and D-directions they are continuously colliding with each other and the centrifuge 1 such that they are subjected to a large amount of limited impacts. Hereby the drill bit buttons 30 are strain hardened and both the toughness and hardness are increased in a relatively foreseeable manner.

When the bottom 4 has been accelerated up to a constant peripheral speed the one or more protrusions 4*b* push the drill bit buttons 30 to follow the speed of the bottom 4. However, due to the repeated pushing of the drill bit buttons 30 away from the wall 3 an average rotational speed of the drill bit buttons 30 in the torus 30*b* may be decreased. The drill bit buttons 30 average rotational speed may therefore be smaller than the peripheral speed of the bottom 4. The drill bit buttons 30 average rotational speed may e.g. be between 70-100% of the peripheral speed. The torus 30*b* will thus rotate with the bottom 4 but at a lower speed. Due to the difference in speed some of the drill bit buttons 30 near the bottom 4 will be pushed upwards, away from the bottom 4, as they pass the one or more protrusions 4*b*.

An operator may hereby perform the method described herein for a selected amount of time until the toughness and hardness of the drill bit buttons 30 has increased to desired levels. In one embodiment with cemented carbide drill bit buttons the toughness increased from 16 K1c units to 24 K1c units at 1 mm from the surface and the hardness increase was from 1190 HV30 units to 1220 HV30 units at 1 mm from the surface.

The drill bit buttons may be made of a composite material such as cemented carbide, cermet or diamond composite and have a hardness above 1000 HV30. In some embodiments a surface of the drill bit buttons is relatively continuous, such that any surface radii are larger than 1 mm.

The drill bit buttons 30 are made of a hard metal, such as a carbide alloy. For example, the drill bit buttons 30 are made of cemented carbide, tungsten cemented carbide, silicon carbide, cubic carbide, cermet, polycrystalline cubic boron nitride, silicone cemented diamond, diamond composite or any other material with a hardness of at least 1000 HV30. HV30 is hardness measured by Vickers hardness test and is commonly used for hard material-testing. Since hardness of a material can be measured by different kind of tests, it is understood that the drill bit buttons 30 are made of a material with a hardness of at least 1000 HV30 or a corresponding hardness measured by other tests. The drill bit buttons 30 can have a toughness of at least 9 units of K1c preferably at least 11 K1c. The toughness, also referred to as fracture toughness, can e.g. be measured by the Palmqvist method as described in US20110000717A1.

Preferable, the ISO standards ISO 3878:1983 (Vickers hardness test for Hard Metals) and ISO 6507:2005 (Vickers hardness test Metallic Materials) are to be used for hardness measurements. If measurements have been done according to another established method conversion tables according to ISO 18265:2013 (Hardness conversion Metallic Materials) for metallic materials may be used. For toughness measurements the ISO standard ISO 28079:2009 (Palmqvist test for Hard Metals) is preferably used.

FIG. 4 is schematic cross-section of the centrifuge 1. In the left part of FIG. 4 pushing elements 3*b* are illustrated. The pushing elements 3*b* may be evenly distributed along the periphery of the side wall 3.

In the right part of FIG. 4 some options are schematically illustrated. In some embodiments a detergent 26 is added for cleaning of the drill bit buttons 30. A corrosion inhibitor 27 may be added for inhibiting corrosion of the drill bit buttons 30.

In some embodiments drill bit button dummies 28 are arranged in the chamber 2. As mentioned above, the bottom 4, the protrusions 4*b*, the side wall 3 and/or the pushing elements 3*b* may comprise or be formed of a plastic and/or rubber surface 29. In some embodiments at least a minimum amount of drill bit buttons 30 or a mix of drill bit buttons 30 and dummies 28 are inserted in the chamber 2 before the method 10 is performed. For example, 30-90 kilograms of drill bit buttons 30 or a mix of drill bit buttons 30 and dummies 28 are inserted in the chamber 2 before the method 10 is performed. Hereby a "critical mass and/or volume" of drill bit buttons 30 or a mix of drill bit buttons 30 and dummies 28 is achieved for which a relatively coherent or well gathered torus shaped body of drill bit buttons 30 or a mix of drill bit buttons 30 and dummies 28 is achieved. This body will, during rotation of the centrifuge 1, be located in the lower peripheral portions of the chamber 2 and the large number of buttons/dummies in the torus shaped body will prevent drill bit buttons 30 to leave the body. The well-gathered torus-shaped body is illustrated in FIGS. 3 and 4.

If the amount of drill bit buttons in the chamber 2 is less than the minimum amount chipping of the drill bit buttons may occur. The well gathered shape of the torus may be lost and the motion of the buttons may be less controlled and thereby the chipping of the drill bit buttons may occur. During one test cycle performed with 10 kilograms of drill bit buttons 30 a larger part of the drill bit buttons were damaged as compared with a test cycle with 30 kilograms of drill bit buttons 30 in the chamber 2.

The minimum amount of drill bit buttons 30 may also be referred to as a minimum filling level of the chamber 2. The minimum filling level can be measured in different manners, e.g. as a minimum weight, or as a percentage of the volume of the chamber 2.

Since the well-gathered torus-shaped body only covers a part of the radius r between the rotation axis and the side wall 3, a distance r1 between the rotation axis and a central part of the well gathered torus represent a central distance or part within the chamber 2 which generally is free from drill bit buttons 30 when the method according to embodiments herein is performed. The distance r1 can be e.g. about 20-60% of the radius r. Since the drill bit buttons 30 generally are located only in the lower, peripheral area, outside of the central part, chipping and breaking of drill bit buttons 30 are avoided. Thus, the peripheral area is the part of the bottom which is occupied by the well gathered torus shape during rotation.

The distance r1 may depend on the amount of drill bit buttons 30 in the chamber 2 and on the rotational speed of the protrusions on the bottom of the chamber. With faster rotational speed the distance r1 increases since the drill bit buttons are pressed away from the rotation center.

Figure 5:
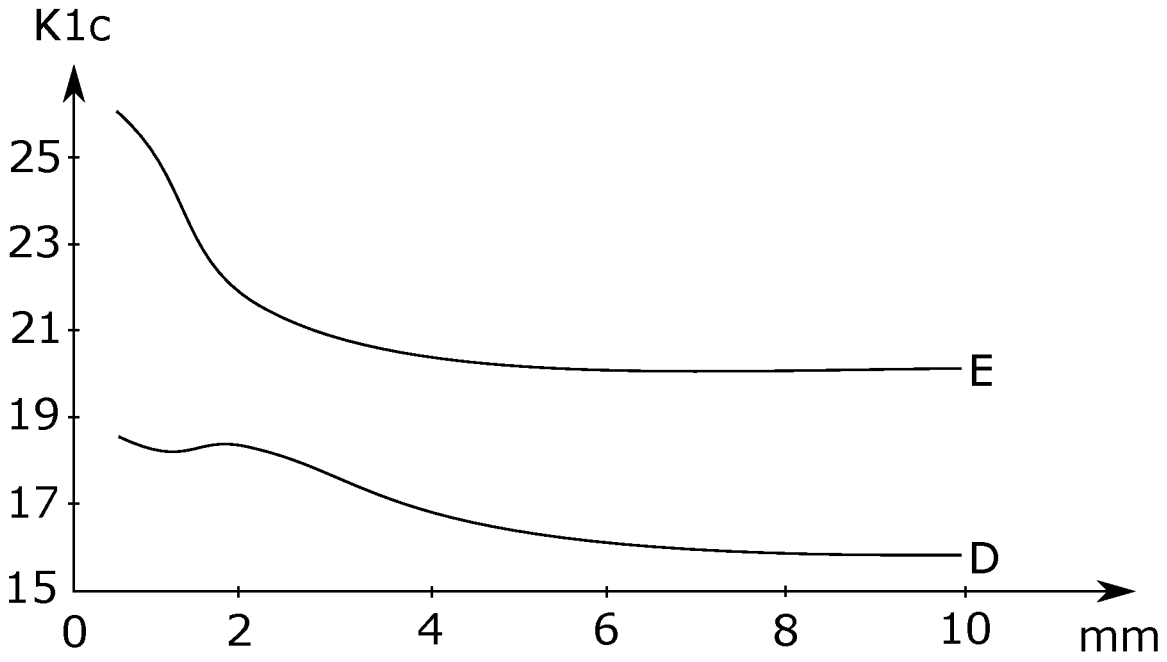
FIG. 5 is a graph over toughness according to some other embodiments.

Graph E in FIG. 5 illustrates the increase of toughness obtained when the method according to claim 1 is used for a duration of approximately 177 minutes. Graph D illustrates the increase obtained by a method according to the state of the art. The horizontal axis show the depth from the drill bit button surface where the properties are measured. The largest increase is close to the surface of the drill bit buttons. At 10 mm in from the surface in this embodiment the toughness and hardness are essentially as before the treatment with the method.

Figure 6:
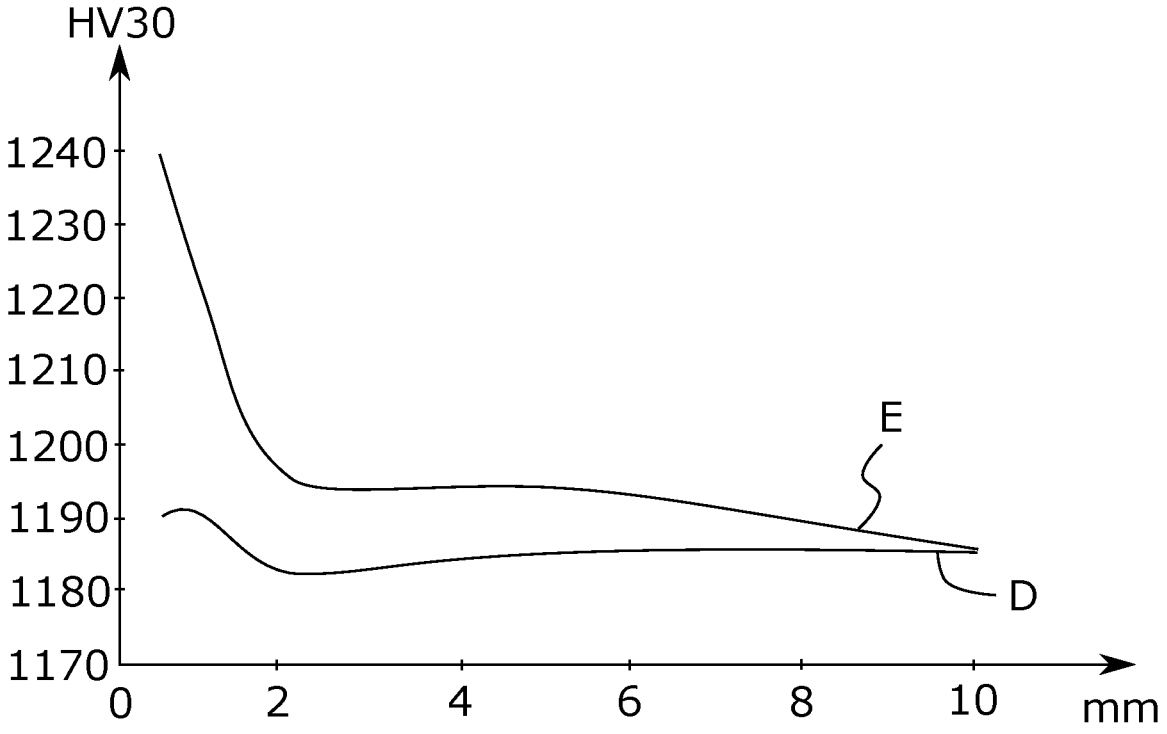
FIG. 6 is a graph over hardness according to some other embodiments.

Graph E in FIG. 6 illustrates the increase of hardness obtained when the method according to claim 1 is used for a duration of approximately 177 minutes. Graph D illustrates the increase obtained by a method according to the state of the art. The horizontal axis show the depth from the drill bit button surface where the properties are measured.

Figure 7:
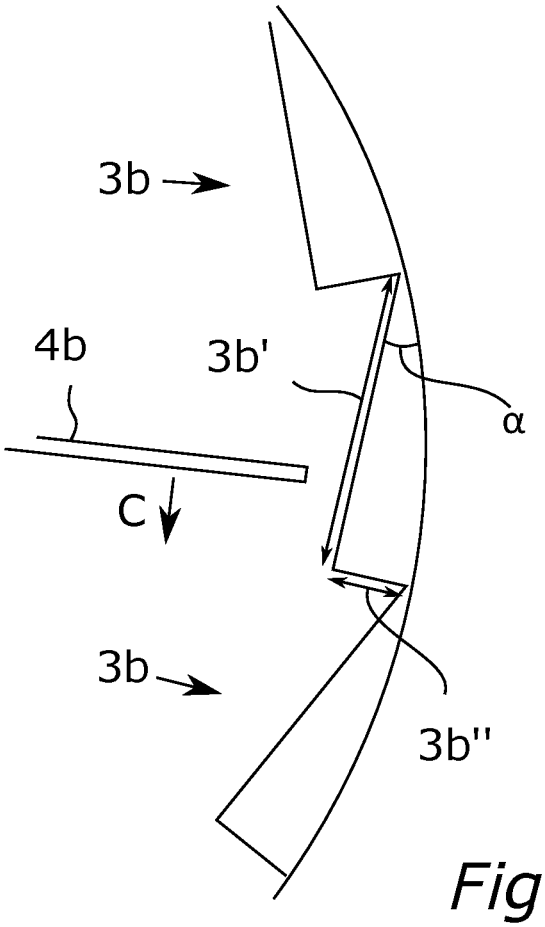
FIG. 7 illustrates details of the centrifuge in FIG. 3.

In FIG. 7 some details of the centrifuge according to some embodiments are illustrated. As illustrated the pushing elements 3*b* may be arranged with a cross-section which is generally triangular. Each pushing element 3*b* may have a length 3*b*' and a height 3*b*". The length 3*b*' may be about 20-50 millimeters, such as about 30 millimeters. The height 3*b*" may be about 5-10 millimeters, preferably 6-8 millimeters, such as about 7 millimeters. The shape and the height 3*b*" of the pushing elements 3*b* are selected such that drill bit buttons which are pressed towards the inner peripheral surface of the chamber during rotation of the protrusions 4*b* in the direction of arrow C are pushed away from the peripheral surface of the chamber. An angle $\alpha$ between the length 3*b*' and the height 3*b*" may be e.g. in the range of 10-20 degrees. The triangular shape of the pushing elements 3*b* has proven to be very efficient for causing a sufficiently large "pushing effect" away from the inner peripheral surface of the chamber without stopping the rotational movement of the drill bit buttons too much. Hereby a controlled movement of the drill bit buttons within the torus is achieved.

The triangular shape of the pushing elements 3*b* has also proven to efficiently prevent the drill bit buttons to "climb" or move upwards along the inner peripheral surface of the chamber during rotation of the protrusions 4*b*. This prevents a maximum falling distance for each individual drill bit button 30 from becoming too large. Hereby damages which otherwise may occur when a drill bit button 30 hits other drill bit buttons 30 with a large difference in relative speed or the bottom of the chamber are avoided.

In one embodiment the chamber has a diameter which is in the range of 300-400 millimeters, such as about 350 millimeters. Such a chamber may comprise 20-40 pushing elements 3*b*, such as about 30 pushing elements 3*b*. The pushing elements may be arranged as illustrated in FIG. 1, i.e. substantially in parallel with the rotation axis.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A method, performed by a centrifuge, for treating toughness and hardness of drill bit buttons, wherein the centrifuge comprises a chamber formed by a stationary side wall and a bottom which is rotatable around a rotation axis, the bottom comprising one or more protrusions which at least partly extends between the rotation axis and the side wall, the side wall comprising at least six pushing elements arranged around a periphery of the side wall, and where the method comprises:

rotating, by rotation of the bottom with the protrusions, the drill bit buttons around the rotation axis, pushing, by the pushing elements, the drill bit buttons from the side wall during the rotation of the bottom, collectively forming the drill bit buttons into a well gathered torus shape at the bottom of the chamber, wherein the drill bit buttons avoid climbing high on the chamber side wall and fall down onto the bottom, for inducing collisions between the drill bit buttons, thereby treating the toughness and hardness of the drill bit buttons.

2. The method according to claim 1, wherein the method comprises:

rotating a periphery of the bottom with a peripheral speed of 4-8 m/s.

3. The method according to claim 2, wherein the method comprises:

increasing the peripheral speed over a time period of at least five minutes.

4. The method according to claim 1, wherein the method comprises:

polishing, by addition of liquid into the chamber, the drill bit buttons.

5. The method according to claim 4, wherein the method comprises:

filtering, by a filter, the liquid.

6. The method according to claim 1, wherein the method comprises:

controlling a temperature of the drill bit buttons by circulating liquid in the chamber.

7. The method according to claim 1, wherein the method comprises:

cleaning, by addition of detergent into the chamber, the drill bit buttons.

8. The method according to claim 1, wherein the method comprises:

inhibiting corrosion of the drill bit buttons by addition of a corrosion inhibitor into the chamber.

9. The method according to claim 1, wherein the method comprises:

treating the drill bit buttons together with drill bit button dummies in the chamber.

10. The method according to claim 1, wherein the method comprises:

providing at least one of the bottom, the protrusions, the side wall and the pushing elements with a plastic and/or rubber surface.

11. The method according to claim 1, wherein the method comprises:

rotating a periphery of the bottom with a peripheral speed of 4.5-7 m/s.

* * * * *